US012447397B2

(12) United States Patent
Riccio

(10) Patent No.: US 12,447,397 B2
(45) Date of Patent: Oct. 21, 2025

(54) BOTTLECAP SOCCER GAME AND METHOD OF PLAY

(71) Applicant: Robert J. Riccio, Alexandria, VA (US)

(72) Inventor: Robert J. Riccio, Alexandria, VA (US)

(73) Assignee: ANIASCIESKE, LLC, Alexandria, VA (US)

( * ) Notice: Subject to any disclaimer, the term of this patent is extended or adjusted under 35 U.S.C. 154(b) by 782 days.

(21) Appl. No.: 17/831,515

(22) Filed: Jun. 3, 2022

(65) Prior Publication Data

US 2023/0285843 A1 Sep. 14, 2023

Related U.S. Application Data

(60) Provisional application No. 63/318,854, filed on Mar. 11, 2022.

(51) Int. Cl.
*A63F 7/06* (2006.01)
*A63F 7/24* (2006.01)

(52) U.S. Cl.
CPC ..... *A63F 7/0616* (2013.01); *A63F 7/2436* (2013.01)

(58) Field of Classification Search
CPC ..... A63F 7/0616; A63F 7/2436
See application file for complete search history.

(56) References Cited

U.S. PATENT DOCUMENTS 4,060,245 A * 11/1977 Gamez Duch ..... A63F 7/0668 273/108.5
5,372,364 A * 12/1994 Arroyo ..... A63F 7/0668 273/108.5
5,431,397 A * 7/1995 Eckel ..... A63F 7/0668 273/284
2011/0153648 A1 6/2011 Ruiz
2011/0156348 A1* 6/2011 Ruiz ..... A63F 9/001 273/277
2017/0266539 A1* 9/2017 Vaughan ..... A63F 7/0616

FOREIGN PATENT DOCUMENTS

GB 150166 A * 8/1920
GB 341998 A * 1/1931

OTHER PUBLICATIONS

International Search Report for related PCT/US23/13971, issued Jul. 10, 2023.
Written Opinion of the ISA for related PCT/US23/13971, issued Jul. 10, 2023.

* cited by examiner

*Primary Examiner* — Kyle R Grabowski
(74) *Attorney, Agent, or Firm* — William Gray Mitchell

(57) ABSTRACT

A scaled tabletop soccer game and method of play, utilizing bottlecaps as players manipulated with the fingers of the participants.

7 Claims, 14 Drawing Sheets

BOTTLECAP SOCCER GAME AND METHOD OF PLAY

CROSS REFERENCE TO RELATED APPLICATIONS

This application claims priority to U.S. provisional patent application 63/318,854, filed on Mar. 11, 2022 and incorporated herein by reference.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

Field of the Invention

The invention is a tabletop soccer game designed to scale and a method of play utilizing bottlecaps as players manipulated with the fingers of the participants.

Background of the Invention

Many board or tabletop games exist that mimic popular sports such as baseball, football and soccer. Most well-known are air hockey and foosball, the latter of which roughly corresponds to a soccer setup, with players rotating handles outside the playing field which are connected to static, upright figures in order to manipulate them to propel a ball over a field and into goals at opposite ends of a rigid table.

The history of sports-related games not requiring a video or full arcade-style table has historically suffered from a difficulty in capturing the fluidity, speed and excitement of actual sports action. Further, the limitations of the tabletop or board game format generally require a set of rules quite different from those of the real sport which the game is intended to mimic.

Applicant's inventive game is intended to closely mirror both the actions and challenges of live soccer players on the pitch and the game's rules to closely mirror those of the sport of soccer. Wherever possible, the game's rules are drafted to follow the sport's International Federation of Association Football's (FIFA) Laws of the Game, thus yielding an immersive, real-life experience for true fans of the sport.

BRIEF SUMMARY OF THE INVENTION

In a preferred embodiment, A tabletop soccer game, comprising: a soccer pitch made of cloth or a similar material marked with lines denoting sidelines, end lines, a midfield line, center circle, penalty areas and goal areas, penalty marks and arcs, corner arcs and defensive player allowable-distance marks, and goal placement marks; 22 bottlecaps, each marked with a different number, each constituting a player, comprising two teams of 11 players, with each team painted a different color; two goals; and a ball.

In another preferred embodiment, the tabletop soccer game as described herein, wherein the lines marking the pitch follow the same relative ratio of dimensions as those of a FIFA soccer pitch as scaled with a bottlecap standing in for the average-sized sport player.

In another preferred embodiment, the tabletop soccer game as described herein, wherein further comprising a Rule Book which presents the game's rules in detail and with illustrations or photos and links to videos depicting all facets of the game.

In another preferred embodiment, the tabletop soccer game as described herein, wherein each player is a bottlecap with a crown, a top side and a crown side, and the standard position of a player on the pitch is resting on the top side.

In another preferred embodiment, the tabletop soccer game as described herein, wherein, wherein each player is one inch in diameter measured from inside the crown, and 0.250-to-0.275 of an inch in height, weighing no less than 0.078 ounces, the weight of a standard bottlecap, and no more than 0.15 ounces painted and/or with inserts.

In another preferred embodiment, the tabletop soccer game as described herein, wherein the ball a ball is spherical, 0.354 of an inch in diameter and weighs 0.4 to 0.5 ounces.

In another preferred embodiment, the tabletop soccer game as described herein, wherein each goal is u-shaped frame comprising two posts and a crossbar with a gauze netting extending two inches back from the frame, such goal measuring six inches wide measured from the inside of the posts and two inches tall from the pitch to the underside of the crossbar, gauze netting extending 2 inches back from the posts and crossbar.

In an alternate preferred embodiment, a method of play of the tabletop soccer game as described herein, played by a first person and a second person, comprising the steps of: 1. the first person kicking off from the midfield line by passing the ball from one player to another, wherein each such move constitutes either a scoop or a tap; 2. the first person continuing to make moves, each such move from the taken group consisting of: repositioning a player, dribbling, passing, shooting, heading, or throwing-in, until possession of the ball changes; 3. the second person making simultaneous moves to counter the first person's moves, such moves taken from the group consisting of: repositioning a player, sliding a player to contest possession, attempting to block or blocking a pass or shot, heading, or diving, until possession of the ball changes; 4. determining possession after each move by measuring a sphere of control constituting either a circle with a six-inch diameter around the player with the ball, wherein (i) a player controls the ball when the ball is solely within the player's sphere of control and (ii) the player closest to the ball controls the ball when the ball is within more than one players' sphere of control; 5. if one player is dribbling and maintaining control, repeating up to five tap moves within such player's sphere of control before the other player may contest possession; 6. the second person contesting possession by sliding a player at the ball from up to 6 inches after the first player dribbles five times, or the dribbling player moves the ball outside his sphere of control; 7. awarding possession to the second person in the event the ball comes to rest solely in the second person's player's sphere of control, or if the second person's player is nearest to the ball; 8. each person continuing to make simultaneous moves and counter moves until a goal is scored, a foul has been committed, or the half or full game have ended; 9. awarding one point to a team each time a person's player scores a goal by having the ball go into the other person's goal; and 10. naming a winner of the game to the person with the highest score, or calling a draw if no person has a highest score, once the game time has expired.

BRIEF DESCRIPTION OF THE DRAWINGS

FIG. 5 is a line drawing evidencing a throw-in.

DETAILED DESCRIPTION OF THE INVENTION

Figure 1:
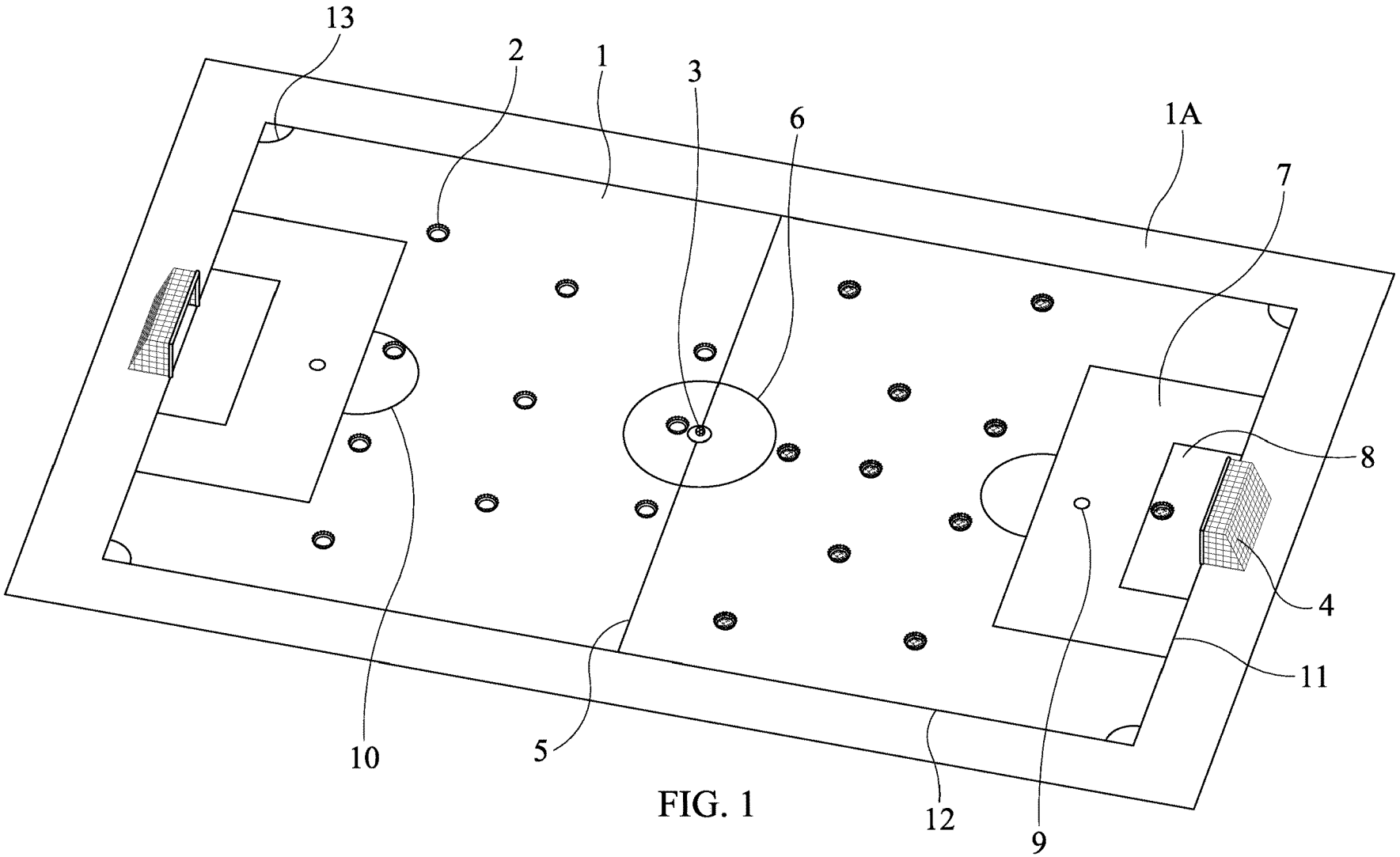
FIG. 1 is a line drawing evidencing pregame setup of the inventive game.

The inventive game constitutes a tabletop soccer game drawn to a scale whose ratios mimic those of the scale of a soccer player to the sport's FIFA soccer pitch, goals, and ball, and method of play utilizing bottlecaps as players manipulated with the fingers of the participants to move an actual ball around a tabletop pitch. The game's scale is determined by using a standard bottlecap as a stand-in for the average-sized soccer player. The game's play is seamless, not by turns, replicates the sport's continuous, field-wide, game-long, simultaneous player movement and rewards the contestant's development of increasingly technical and complex individual player movements. The game's rules are intended to match FIFA rules as closely as possible. Preferably, the game is self-refereed by the two persons playing. For rules such as the determination of unsportsmanlike conduct or intentional rule breaking, a third-party referee should be employed.

The game has nine types of pieces: (1) twenty-two uniformed bottlecaps, (2) a ball, (3) a playing field with markings, (4) two goals, (5) four corner flags, (6) a scoreboard/timer, (7) a folding, transparent, 6-inch ruler, (8) a rules booklet, (9) a cylindrical carrying case with a handle and a shoulder strap.

In a preferred embodiment, the game pieces further comprise:

- a soccer pitch, which is a smooth green carpet and measures 56 inches long (along the touch lines) by 37 inches wide (along the goal lines), and wherein the line markings on the pitch follow the same relative ratio of dimensions as those of a FIFA soccer pitch, and are marked with white lines ⅛ of an inch wide denoting sidelines, end lines, a midfield line, center circle, penalty areas and goal areas, penalty marks and arcs, corner arcs and defensive player allowable-distance marks, and goal placement marks;
- 22 bottlecaps—each bottlecap constituting a player, 11 bottlecaps constituting a team, there will be two teams, each team will be differentiated from the other by being marked (in any fashion desired) with a distinct uniform color(s) with the goalkeeper using a distinctly different color from the 10 field players on his team, and each bottlecap having a different number on both sides;
- four corner;
- a game scoreboard/timer with a 6-inch ruler inside—usable for sphere of control and player movement measurements;
- two goals (which are u-shaped, 6 inches wide measured from the inside of the posts, and 2 inches tall from the field to the underside of the crossbar. The vertical posts and horizontal crossbar are cylindrical and have gauze netting extending 2 inches back from the posts and crossbar, and meeting at side and backstops blocking the ball from running through); and
- a ball (which is spherical, 8.5 mm or 0.354 of an inch in diameter, and weigh 0.4 to 0.5 ounces, the weight of a U.S. penny, and be made of acrylic plastic, and may be of different colors).

The inventive game is intended to closely mimic the appearance of an actual soccer match. The scale field is to be properly marked and dimensioned in accordance with known soccer rules, and each side is to have eleven "players", each player embodied as a bottlecap with team colors and a player number appearing on each side. For the purposes of this application, the term "player" will mean a bottlecap and the term "person" will mean a person playing the game.

The bottlecaps themselves are exactly the same in size and appearance as a standard bottlecap taken from a beer or soda bottle. While on the pitch, the bottlecaps will remain in a crown-up position, each thus forming a cup shape. The ball will be an acrylic plastic spherical object of a weight of a U.S. penny. The playing field or "pitch" will be embodied as a flat, rectangular, smooth, green carpet or a material of similar texture. Lines will be drawn onto the pitch to denote the playing area, with side lines, end lines, a midfield line with center circle, penalty areas, goal areas, markings for goal post positioning, the distance a defensive player may be from a person taking a corner, and the corner arcs. Each team will have a goal positioned in the center of its endline, inside the goal area. A player kicking the ball into the opponent's goal will be awarded one point—a goal.

A game shall consist of 24 minutes of continuous play divided into two 12-minute halves with sides of the field switched for the second half. If extra time is needed, 8 additional minutes will be played in two 4-minute halves with field sides switched at half time. A penalty shootout will follow a tied match after extra time. Five shots will be taken by each team and the one scoring the highest number of penalties wins. If there is a tie after each team has taken five penalties, then the teams take one penalty at a time in turn until a winner is obtained.

The following explanation will focus on various terms of art regarding game play.

Scoop and Tap. The game allows for many types of movement but the two basic types of player movement for ball manipulation are a "scoop" and a "tap". For a Scoop, a person grasps the bottlecap with fingers placed on either side of the cap, keeps their hand in contact with the field, and swipes their fingers upward with a twist of the wrist, having the effect of scooping the ball with the player—as if scooping a spoonful of ice cream—for a shot or pass. For a Tap, a person places their finger inside the crown of the bottlecap, and again while keeping their hand in contact with the field, moves their finger sliding the bottlecap toward the ball to tap the ball along the playing surface in any desired directions.

Headers and Throw-Ins. Two secondary player movements, headers and throw-ins, require the ball be inside the crown of the bottlecap. The movements are nearly identical for each action. The player is held by the person with a thumb and finger on either side of the crown of the bottlecap to complete the motion—which is similar to the way in which the fingers and wrist move to snap one's fingers—the player thus propels the ball in the desired direction. All motions by a person, of whatever type, involving field players, require that contact between the person's hand and the playing surface be maintained throughout the motion. For a header—the ball must land inside the crown as a consequence of the run of play. A header may take place anywhere on the field, but a header taken as an attempt to score a goal may only be taken from inside the opposition's penalty area. All headers may be taken immediately upon the ball landing inside the crown of the bottlecap. For a throw-in, the person places the ball inside the crown of his player and then places the player out of bounds where the ball left the pitch. At that point the player performs the above-mentioned throw-in movement. The player may not cross the plane of the sideline boundary when completing a throw-in. If he does cross that line the ball is awarded to his opponent, and then he gets to attempt a throw-in from the same spot.

Player Movement without the Ball. All players may be repositioned at any time during the run of play, but, with few exceptions, they may only be repositioned individually and only six inches at a time. The manner of movement for that repositioning is by sliding the bottlecap with the same motion used to tap or dribble the ball but letting go of the player at the end of the forward motion. If the person wants to move the same player again, he must wait a beat (count out "one one-thousand") before attempting the move. While all players may be picked up, they may only be picked up to perform the specifically described movements listed herein which are all performed while addressing the ball. With the exception of the goalkeeper's movement (described below), the only times players not addressing the ball may be picked up are in the wholesale repositioning cases (for a kickoff, corner kick, goal kick, penalty kick, or free kick). As in the sport of soccer, various rules are used to govern the manner of play, such as determining which player has a right to address the ball, when one player may contest the possession of another, when various types of passes and kicks may be attempted, etc.

A game begins with each person arranging their 11 players in formation on their side of the field. Traditional soccer formations, such as the 3-3-4 or 4-4-2, may be used but are not mandatory. When the players are set, one person will be designated to kick off from center field while the other starts the timer. After the kickoff, play is continuous and uninterrupted until the end of a period of play has been reached or an infraction has taken place. For example, a person may use one hand to manipulate the player in possession on a dribble, and his other hand to simultaneously and continuously move any other player(s) on his team into a more advantageous position (six inches at a time), a position toward which the dribbler may simultaneously decide to pass. Similarly, the person playing defense may be manipulating the player closest to a dribbler, sliding him to contest possession, for example, while with his other hand repositioning another defender, far from the action with the ball, to place him in a more advantageous defensive position. One contestant may not infringe upon the other's ability to play, including affecting his ability to play with both hands simultaneously. While these actions take place the persons must allow each other the space and access to make their respective moves.

Sphere of Control. The concept of a sphere of control is one rule not found in real soccer, but that is integral to the inventive game. A player has control of the ball (possession) if he is the closest one to it. The controlling player's Sphere of Control is the area around him within which he is indisputably the closest player to the ball. That area, though, may only extend up to six inches in diameter around him. While in possession within his Sphere of Control, the player may dribble, pass, or shoot. But if he moves the ball to within less than six inches from an opposing player, then control of the ball will shift to whoever is closest to the ball, and that distance—the circumference within which the player is closest to the ball that any other player—will become the Sphere of Control for the player in possession. If the new player obtaining control is on the other person's team, then a turnover will have occurred. If the player originally in control continues to be the closest to the ball, he retains control and may proceed. While proceeding in possession, for example by dribbling, the player in possession can be progressing down the field and his Sphere of Control moves along with him.

Direction of play. The direction the player in possession chooses to progress towards will be considered the direction of play. In that manner, a player in possession may decide to dribble back toward his own goal or sideways toward a sideline where there is more room to maneuver. If the direction the player in possession is moving in is not clear, then it is assumed the player in possession is moving toward his opponent's goal. Defenders attempting to contest the player in possession—by sliding in, to contest possession, or to block a pass, or shot, or header—must be ahead of the direction of play in order to become involved with the play. To become involved with the current play, those defensive players not ahead of the direction of the play must be moved, six inches at a time, until they are ahead of the direction of play.

Dribbling is performed by putting a finger inside a player and sliding the bottlecap until it makes contact with the ball, tapping the ball, while keeping the ball within the player's sphere of control at all times. A single player may successfully dribble up to five times in a row without being contested by an opposing player. Any player obtaining or keeping control after a contest, as described below, will have the ability to again dribble for up to five taps. A dribbler who has gotten past a defender and left him behind the direction of play has in effect eliminated that defender from the current play.

Contest of Possession. After five taps, or whenever the ball enters a free area outside any one player's sphere of control, the opposition may contest possession by sliding their closest bottlecap to the ball, which is within six inches of the ball, toward the ball. That contesting takes place even though the ball is in the dribbler's sphere of control. The slide is performed with the same motion as a tap only the bottlecap itself moves or slides toward the ball in contention and the player is released at the end of the motion. The person whose player is in control may keep his finger inside his bottlecap while being contested but may not press down or place his bottlecap over the ball or move his bottlecap to affect contact with the sliding contestant. The player contesting possession need not wait for the dribbler to notice he has dribbled five times or placed the ball in contention, but the dribbler, if he notices the defender is unaware, and wants to continue dribbling, must pause a beat after five taps to allow his opponent to contest. If, after that pause, the opponent does not contest possession, the dribbler may proceed to take another five taps.

Contact in a dribble contest of possession is to be initiated by the defender. Contesting a ball which no player has control of requires both contestants to slide their closest bottlecaps to the ball at the ball with just enough force to reach the ball. Neither contestant need wait for the other to slide his player and if one person hesitates the other may well slide first and obtain possession. If the ball is not six inches from either of the opposing players, the persons must slide their closest caps to the ball, six inches at a time, to be within a six-inch reach of the ball and then contest to lay claim to possession. Bottlecaps may crash/clash into one another in contesting for possession. If the bottlecaps clash but do not flip, play continues with the closest player to the ball obtaining possession. If a cap is flipped the flipped cap has been fouled and is awarded a foul kick from the spot of the flip. If a defensive player contending possession clashes against a dribbler and the dribbler remains crown up but the sliding player flips, even though it was the defender who initiated the clash, it is the dribbler who has committed the foul by flipping his opponent. Only defensive players positioned in front of the direction of play are considered involved "in the action" and may contest the ball. Those players behind the direction of play of the controlling player (determined by the direction in which the player in possession is moving) are "out of the action" and cannot contest. They must be moved, six inches at a time, until they are again ahead of the action to be able to contest play.

Change of Possession. Upon a change of possession, the game action will continue without stopping. The player newly taking control need not dribble, pass, or shoot, he may simply choose to reposition some other player(s) first. But if the possession change took place in a contested sphere of control, and the player in control, opposing player, and ball, are inside a space smaller than a six-inch diameter, if the player now on the offensive does not at least tap the ball—indicating he is going to dribble—the defender need only wait a beat before contesting the ball again. It is when the player newly in possession decides to dribble, that the defense may not contest possession until the controlling player has concluded his initial five taps (and he only has five seconds to begin that dribble by taking his second tap). If the player newly in possession decides to stop dribbling to pass or shoot, his opponent, if within six inches and ahead of the direction of play, may attempt to block. If the player in possession decides to continue dribbling the defending player may eventually contest the dribbler as described above.

Shots at goal (either by tap or scoop motion) may only be taken if the ball and shooting player are located in the opposition's half of the field and in the space between the farthest reach of the opposition's midfield semicircle and their goal. A shot at goal may be taken at any time in the run of play, from inside that legal distance, without warning and that shot may result in a goal.

Volley and Ricochet Shots. Scoring a goal does not require a shot or header be taken by the offensive player with control of the ball. The player in control may decide to pass the ball to a teammate making a run into the penalty area. That pass, ricocheting off the player making a run may culminate in a goal scored. A ricochet goal will only be legal if the ricochet took place inside the penalty area. The player choosing to use one hand to pass into the penalty area and another hand to send a teammate on a run, need not warn his opponent of the intended potential ricochet shot. Similarly, should the player in possession scoop pass the ball in the air to a teammate, who upon receiving the pass would be obviously within the legal shooting range and clearly in possession, that receiving teammate may choose to attempt a volleyed shot off of the pass, and do so without warning. The same volleyed shot may be taken whenever a player is clearly going to be in possession and within legal shooting range when the ball arrives—and it may arrive from a throw-in, header, pass, ricocheted pass, bounce off a defender, block, ricochet off a crossbar or post, or from a keeper save.

Block. Shots, passes, throw-ins, and headers may be blocked. A block is performed by putting a finger inside a player and sliding the bottlecap along the field toward the expected direction of the opponent's action not toward the player taking the action. The person attempting the block may also choose to keep his finger inside the crown of the bottlecap at the conclusion of its slide and then press down upon it—in effect placing the bottlecap upright—to attempt a standing block. At the conclusion of a standing block, as a seamless part of the movement, (without the pause a keeper might take when advancing and then diving—see below) the player may be rolled in the upright position toward the direction of the ball as an added blocking devise. However, the slide cannot take place from more than six inches away from the player controlling the ball and the player sliding must be in front of the direction of play.

Foul. A foul occurs when (1) a bottlecap from one team upends (turns over) an opposition player. This can happen often when players vie for the ball. When two players are going to contest the ball, they slide toward the ball and often crash together. Another foul occurs if one player comes to rest (2) partially or (3) fully on top of another due to a clash, slide tackle, blocked shot attempt, or similar movement. In these two circumstances, the player on top is deemed to have committed the foul.

Hand Ball. A player commits a handball when he lands, crown-side down, on top of the ball, covering it, whether partially or completely. If the action is purposeful the player is awarded a yellow card. If the action takes place inside his penalty area the opposing team is awarded a penalty. If a bottlecap lands on top of the ball with the smooth side over the ball, it is not a hand ball, it considered the same as if the sport's player were simply placing his boot upon the ball.

Penalty Kick. Penalty kick game rules follow FIFA's Laws of the Game. To take a penalty the goalkeeper is placed with only one or two fingers, by the person playing defense, on the goal line between the goal posts. This is performed by holding the goalkeeper with a hand that reaches over the goal to put the keeper in position. The person playing defense whistles for the penalty to take place and the person whose player is taking the penalty must shoot within five seconds of the whistle.

Cards: cautions or disqualifications. If a single player commits two fouls of any type, that player receives a caution (known as a yellow card); if a single player commits a third foul (of any type) the player automatically gets a red card (or is disqualified) and is expelled from the game, and the player's team must thereafter play shorthanded.

Law of advantage. As in the sport of soccer, a player being fouled may choose to ignore the foul and continue the play's action if he feels he is still in an advantageous position and accepting the foul would work to his disadvantage. A person whose player has been fouled can simply call out "advantage" and continue the play. If the foul involves an opponent landing on the fouled bottlecap, the person whose player was fouled may slide his player out from under the opponent but may not pick up the other person's player. If when the foul occurred, the ball rolled or flew away from the location of the foul the person whose player was fouled may place the ball back at the spot of the foul. But if the ball landed within clear possession of a teammate of the fouled player the person may choose to continue play from that new location and with that new player now in possession.

Inadvertent Touching. When a person inadvertently touches and moves a game piece, be it a player, goal, corner flag, or the ball, the pieces will be reset and, if a move was in progress, the move will be replayed. If the infraction occurs just prior to the end of a half or the full game, 30 seconds may be added to allow the replay, the Law of Advantage being the determining factor. If the touching is deemed intentional the player calling out the infraction may so state. See unsportmanlike activity foul below.

Technical Foul. During the game's action, Person A may call out "technical foul" if he feels Player B has broken a rule, including

- picking a player up for any movement other than those allowed,
- moving a player more than six inches at a time,
- using a player behind the direction of play to attempt a block,
- moving the ball while not in control,
- taking a shot while not in control of the ball,
- wasting time—intentionally taking too long to right a wrong such as knocking a ball, goal or corner flag away or out of position with a person's body part and dawdling over placing the object back in place, or taking too long to do a goal kick, free kick, penalty kick, corner kick, or throw-in—a person is allowed five seconds after the game part is misplaced to rectify the situation and an additional five seconds to take a goal kick, free kick, penalty kick, corner kick, or throw-in,
- lifting the hand off the turf while his player is striking the ball,
- touching the ball with any part of a person's body,
- moving any other bottlecap to accommodate manipulating the player with which the person is attempting any movement,
- moving the corner flag or goal from their locations,
- failing to abide by any of the game rules during the course of play, and
- continuing to play after an infraction has been called.

Unsportsmanlike activity foul. If a person's inappropriate touching of any game piece is deemed a purposeful, unsportsmanlike interruption of play the obstruction results in a foul, as detailed below. The ball is placed on the spot of the body-part touch or is taken from the spot at which the player in control launched the ball. Any touching of any player in order to manipulate another player a person wants to move will be deemed intentional. A fourth foul during any game, which is due to unsportsmanlike activity by a person, results in that person's forfeit of the game.

Free Kick and Defensive Walls. Game rules for free kicks follow FIFA's Laws of the Game. A free kick can be taken at goal as long as it is within the legal shooting space as described above. If the person taking the free kick intends on shooting directly at goal, he must so state in order that the defender may place a defensive wall. The wall is placed three bottlecap lengths away from the position of the ball and is built by placing the defensive bottlecaps smooth side against smooth side to in effect stand up the bottlecap. Defenders may place as many players in the wall as desired and once the first two are upright other bottlecaps as pairs or singly may simply be placed alongside to augment the wall. No defensive players may be inside the three bottlecap circumference around the location of the ball until the ball has been played. Once the wall is set the defender states he is ready and then the offensive player has five seconds to play the ball. Once the shot has been taken the defender may dismantle his entire wall by picking up and placing the defenders back down on the playing field within three cap lengths of where the wall stood, thereafter he may only move his players singly and six inches at a time.

Corner and Goal Kicks. Game rules for these kicks follow FIFA's Laws of the Game. Both teams may move players wholesale during a goal kick by picking them up and placing then where desired. The player taking the corner or goal kick must wait for his opponent to relocate his players and then has five seconds to take the kick from when the ball is put in place, or he will be awarded a yellow card (caution).

Goalkeeper's Movement. The goalkeeper is the only player in the game that a person may hold with only the fingers, without the hand having to be in contact with the field, but with an edge of the keeper in contact with the pitch. To play the keeper the person picks up the bottlecap in one of four ways and places it upright with one part of the bottlecap in contact with the pitch and the crown side facing the play. A person may (1) hold the bottlecap on both sides of the crown with his index and thumb on either side of the bottlecap, or (2) with his index and middle fingers on one side and the thumb on the other side, or (3) with his thumb and middle finger holding opposite sides of the bottlecap while his index finger lies on the top of the bottlecap with its bottom in contact with the pitch, or once he has picked the keeper up and placed him, he may choose to (4) place a single finger on top of the bottlecap to hold him in place (for example during a penalty kick) or roll him for a save. From the first three grip stances the keeper may advance.

The keeper advances by simply being picked up, moved, and placed up to six inches in any direction, at which point he may remain in place and/or turn to attempt to block or cut off the angle of a shot, slide to block a shot from his current stance, or dive to attempt a shot block. A keeper may only move six inches twice consecutively without waiting a beat, but he may only do so as long as he touches the field of play before each move and the second move culminates in an attempt at a save or a block by either diving (being flung) in the direction of the ball, turning to attempt a shot block from his stance, or by performing a field player's block. To perform a dive, the only keeper movement which requires the person maintain his hand in contact with the field, the person holds the keeper in any of the first three mentioned grip stances and then flings the cap, with the inside of the crown facing the ball, for a distance of up to six inches, in an attempt to block the shot. The keeper may not be moved more than twice in a given play but may repeat his two moves if the offensive player makes an immediate second attempt to score such as following up on a ricochet off a post or off the keeper's save. Special Field Player Movements. Bottlecap Soccer players can do almost anything the real sport players can. Game players can perform special moves, such as bicycle kicks, back heel passes and shots, or diving headers. To do a bicycle kick, the kicking player is facing the ball and away from the direction of play. The player attempts to send the ball over its head and in the opposite direction from that which he is facing. The user holds the bottlecap on both sides of the crown with his index and middle fingers on the side facing the ball and a thumb on the other side. Then user flicks his wrist, and flips the bottlecap, thumb over fingers in a snapping motion—which propels the ball backwards in a scooping motion. At the end of the motion, the user must let go of the player who might land crown down, in which case the user must flip the player into to its normal cup stance. To perform a backheel shot or pass, a user places a thumb and middle finger on either side of the bottlecap while placing an index finger inside the crown. The user thus lifts one side of the bottlecap off the pitch by pressing down on the side of the crown, while the opposite side of the bottlecap continues to be in contact with the pitch. User then places the smooth side of the bottlecap over the ball and press down upon it while sliding the bottlecap forward or backward over the pressed ball to propel the ball in the desired direction. A diving header is performed by gripping the bottlecap in the same manner as when performing a backheel, but the user then turns the bottlecap crown side down. Then, switching to grip the bottlecap with an index finger and thumb, the user must fling it (from no further than six inches) toward the ball in an attempt to have the flying ball meet up with the now-flying bottlecap. The user is trying to meet the ball with the outside of the bottlecap's crown but not with the inside of the crown or the top side of the bottlecap. Hitting the ball with any other part of the bottlecap is allowed, but a diving header entails contact with only the side of the crown. Such contact, if it propels the ball into the goal for a score is allowed even if the header is missed and the ball strikes a different part of the bottlecap. In those cases the persons involved can simply assume the ball was struck with another legal part of the body as often happens in the sport. At the end of the movement the user must let go of the player who might land crown down, in which case the user must flip the player into his normal cup stance.

Special Field Player Movements. Bottlecap Soccer players can do almost anything the real sport players can. Game players can perform special moves, such as bicycle kicks, back heel passes and shots, or diving headers. These moves are depicted in detail in the rule book.

DETAILED DESCRIPTION OF THE FIGURES

FIG. 1 shows the tabletop soccer game pieces arranged for play prior to the kickoff beginning a game. The game has nine types of pieces: a playing field with markings 1 surrounded by an out of bounds area 1A, twenty-two uniformed bottlecap players 2, a ball 3, two goals 4. In addition, the standard game version will also contain the following pieces that are not pictured: four corner flags, a scoreboard/timer, a ruler, a rules booklet, and a cylindrical carrying case with a handle and a shoulder strap.

Also indicated are the various lines or marks comprising the playing field 1, including 5 a midfield line 5, center circle 6, goal area 7, penalty area 8, penalty mark 9, penalty arc 10, goal line 11, sideline (touchline) 12, and corner arc 13.

Figure 2:
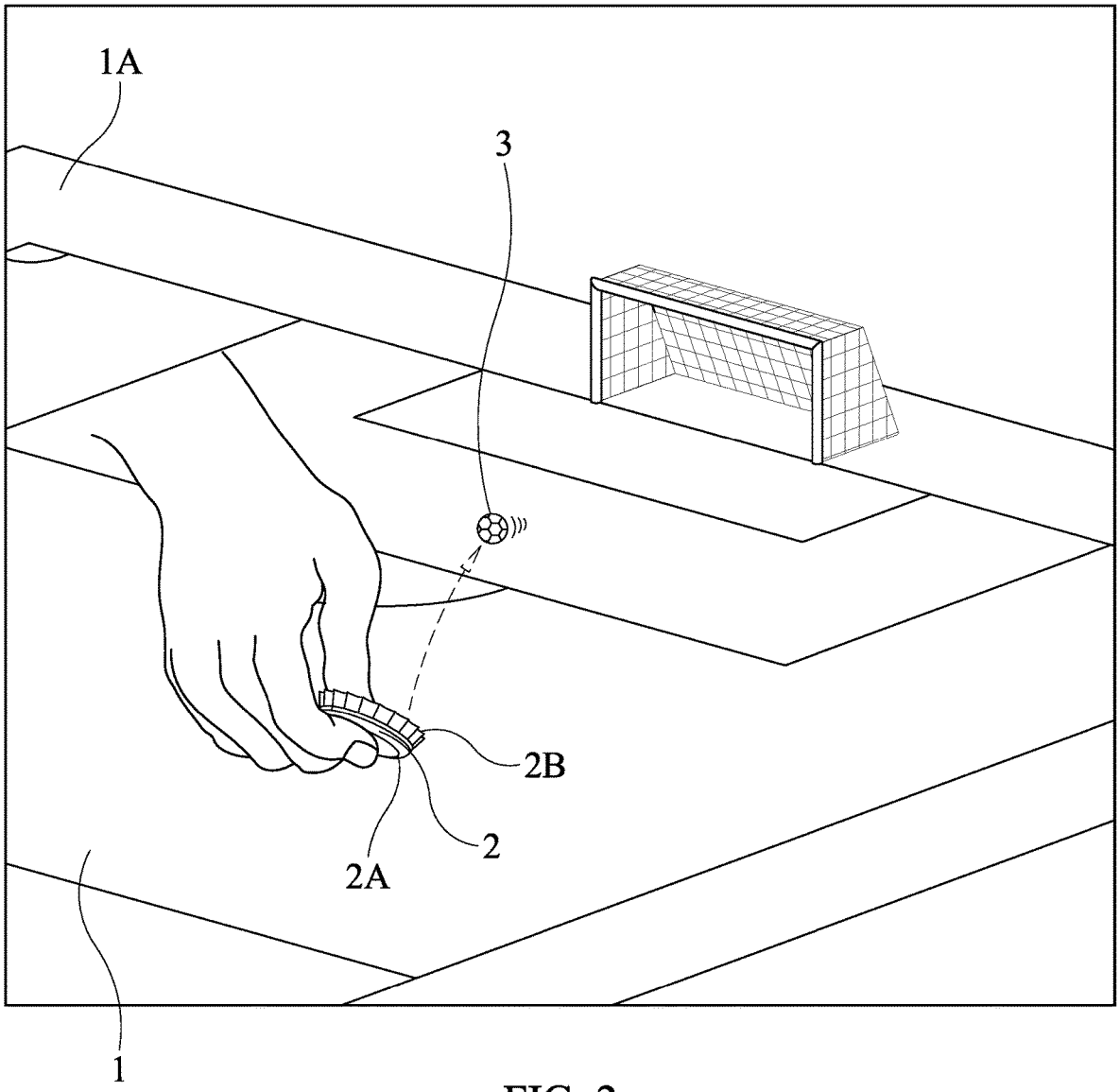
FIG. 2 is a line drawing evidencing a scoop motion.

FIG. 2 shows a user executing a scoop shot, wherein the user grasps a bottlecap player 2 with the index and middle fingers placed on the top 2A of the player and their thumb on an edge of the crown 2B. Then, while keeping his hand in static contact with the field 1 throughout the motion, the user swipes their fingers upward with a twist of the wrist—as if scooping a spoonful of ice cream—having the effect of scooping the ball 3 with the bottlecap player 2 for a shot or pass in the air, above the surface of the field 1.

Figure 3:
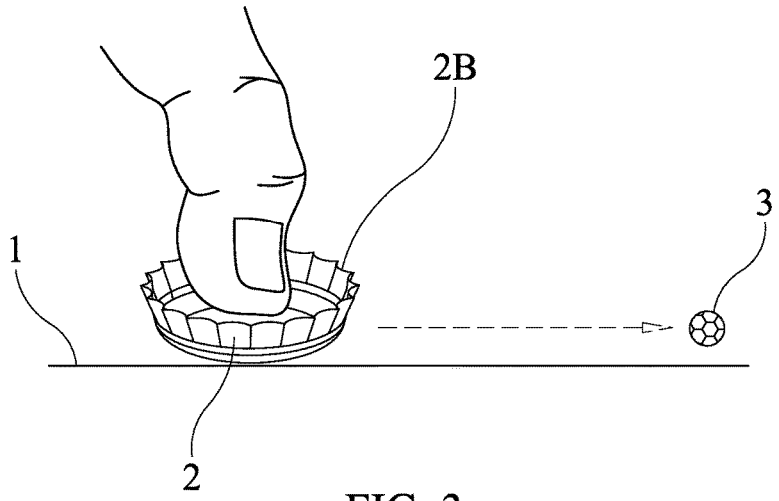
FIG. 3 is a line drawing evidencing a tap motion.

FIG. 3 shows a user executing a tap motion, wherein the user places their finger inside the crown 2B of the bottlecap player 2, and while keeping their hand in contact with the field 1, moves their finger pressing down and forward to slide the bottlecap player toward the ball 3 to tap it along the field 1 in any desired direction. The motion stops once the bottlecap player and ball make contact, with the follow-through being naturally checked by the static location of the user's hand on the field 1.

Figure 4:
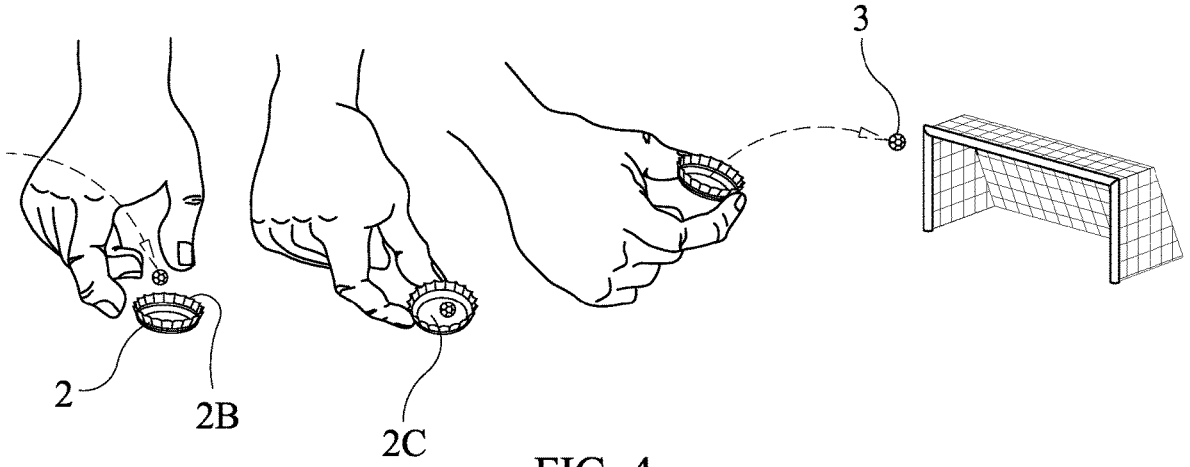
FIG. 4 is a line drawing evidencing a header.

FIG. 4 shows a user executing a header shot, wherein the ball 3 has landed inside the crown 2B of a bottlecap player 2, and therefore the ball is initially located on the inner surface 2C, inside the crown 2B, of the bottlecap player 2. The player 2 is held by the user with a thumb and finger on either side of the bottlecap's crown 2B while keeping the ball 3 in the crown and with the hand in contact with the field throughout the motion. Then, with a twist of the wrist the ball 3 is propelled in the desired direction. The movement is similar to the way in which the fingers and wrist move to snap one's fingers.

Figure 5:
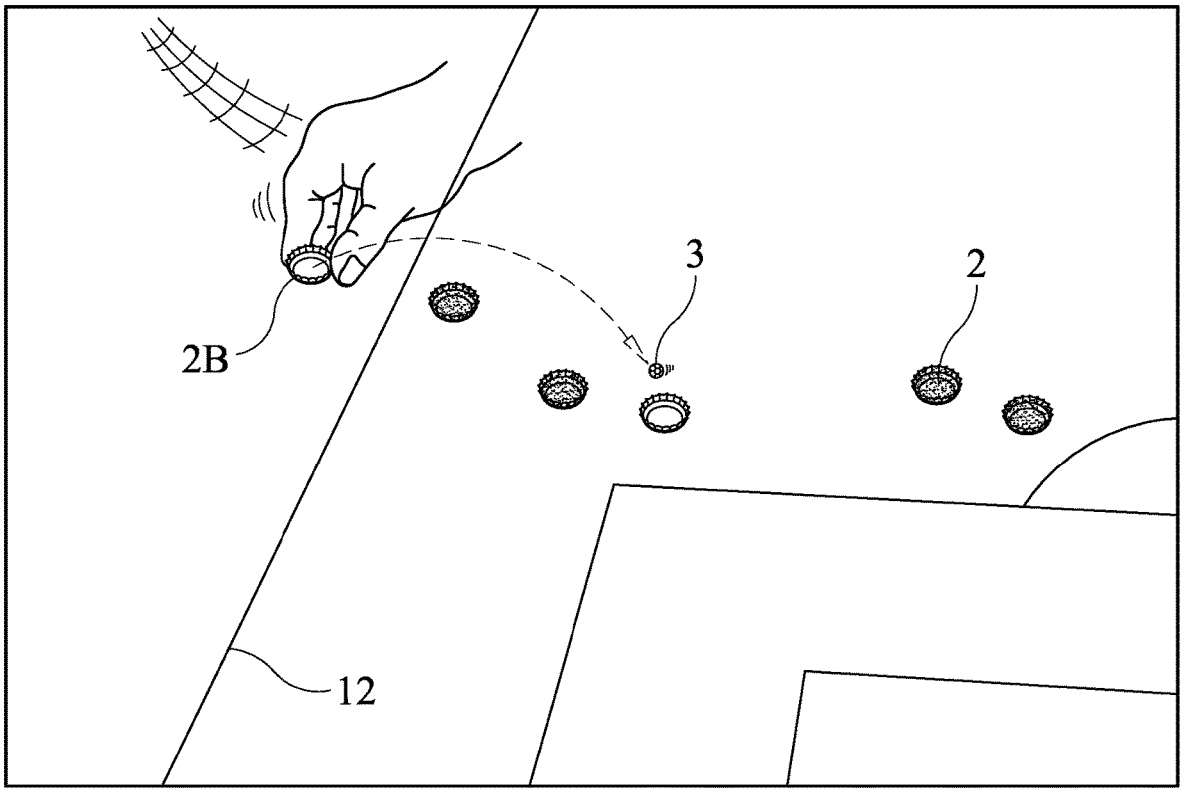

FIG. 5 shows a user executing a throw-in to reintroduce the ball 3 after it has crossed a sideline 12 to go out-of-bounds. For a throw-in, the ball 3 must be placed inside the crown 2B of the bottlecap. The bottlecap player 2 is held by the user with a thumb and finger on either side of the bottlecap's crown while keeping the ball in the crown and with the user's hand in contact with the field 1 throughout the motion. Then, with a twist of the wrist the ball is propelled in the desired direction. Again, the movement is similar to the way in which the fingers and wrist move to snap one's fingers. For all drawings showing game play, defensive players will appear shaded in gray.

Figure 6A:
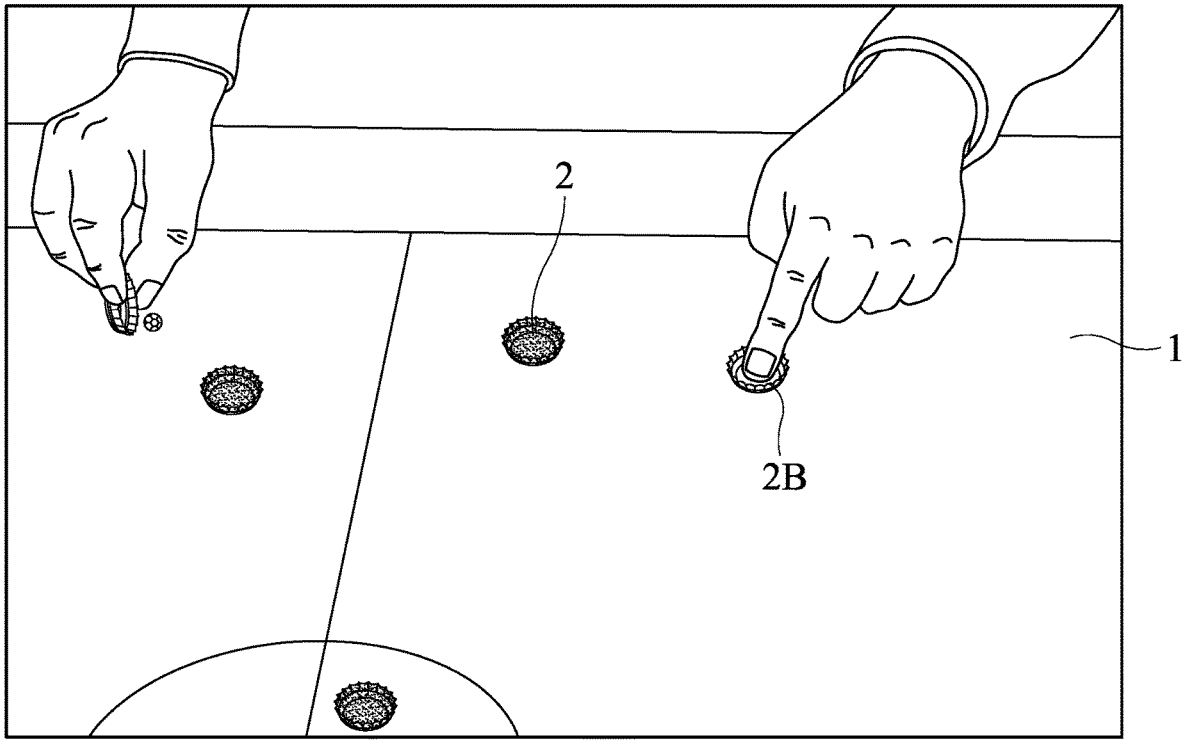
FIG. 6A-6C is each a line drawing evidencing a player movement without the ball.
Figure 6B:
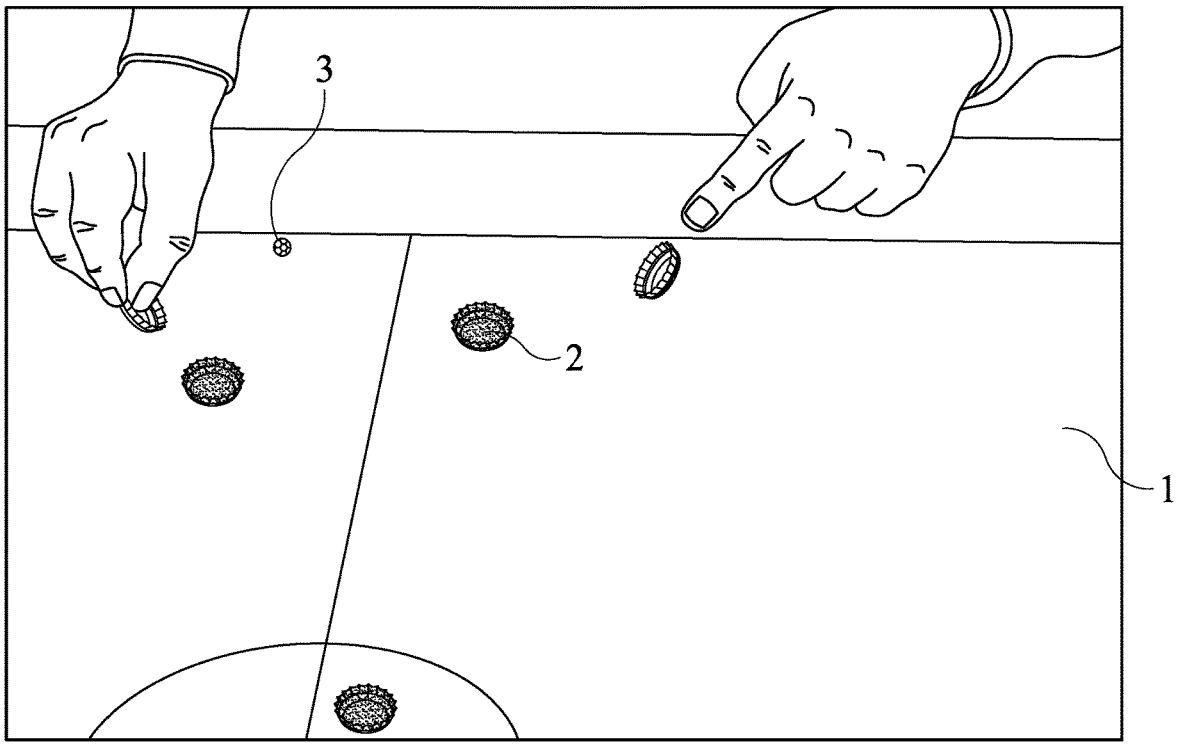
Figure 6C:
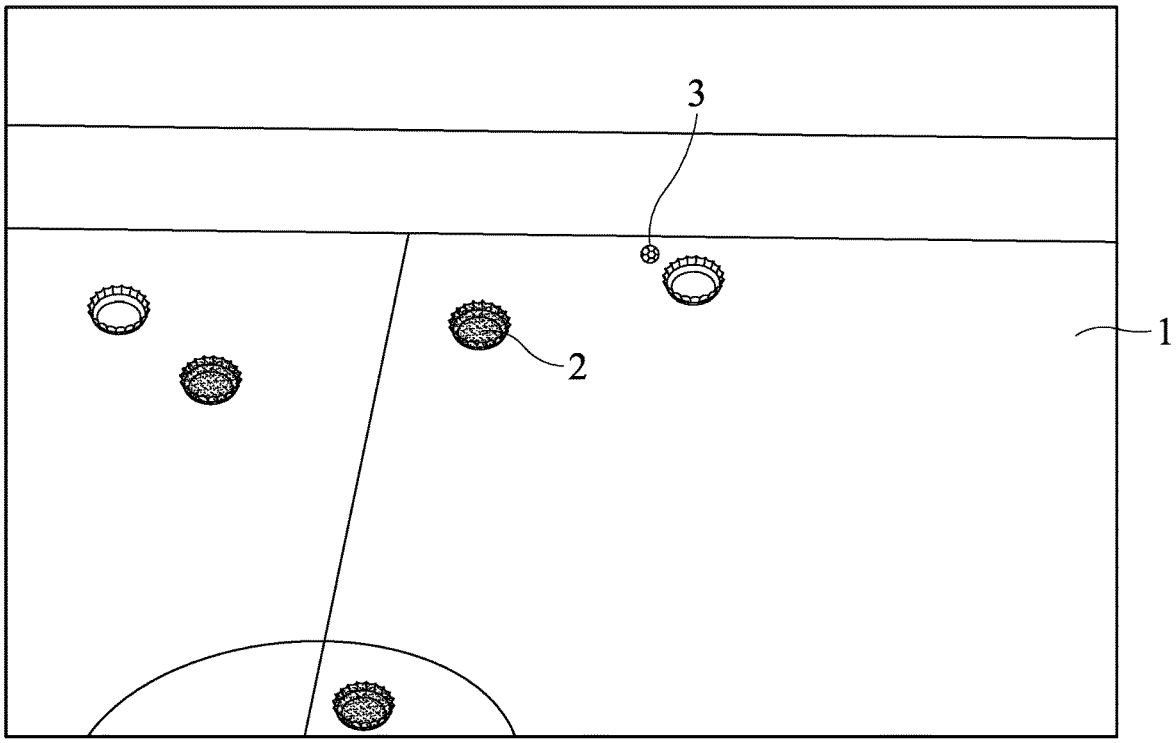

FIGS. 6A-6C shows movement of a bottlecap player 2 when not in possession of the ball 3. For a player to move without the ball, the manner of movement by sliding the bottlecap along the surface of the field 1 with the same motion used to tap or dribble the ball 3, but letting go of the player at the end of the forward motion. FIG. 6A shows a user with his finger inside the crown 2B of a bottlecap player 2 while another player has possession of the ball. In FIG. 6B, the user pushes the player 2 towards the midfield line 5 with a finger, releasing the player during the push. FIG. 6C shows the pushed player 2 coming to rest near the ball 3, which has been kicked by another player.

Figure 7:
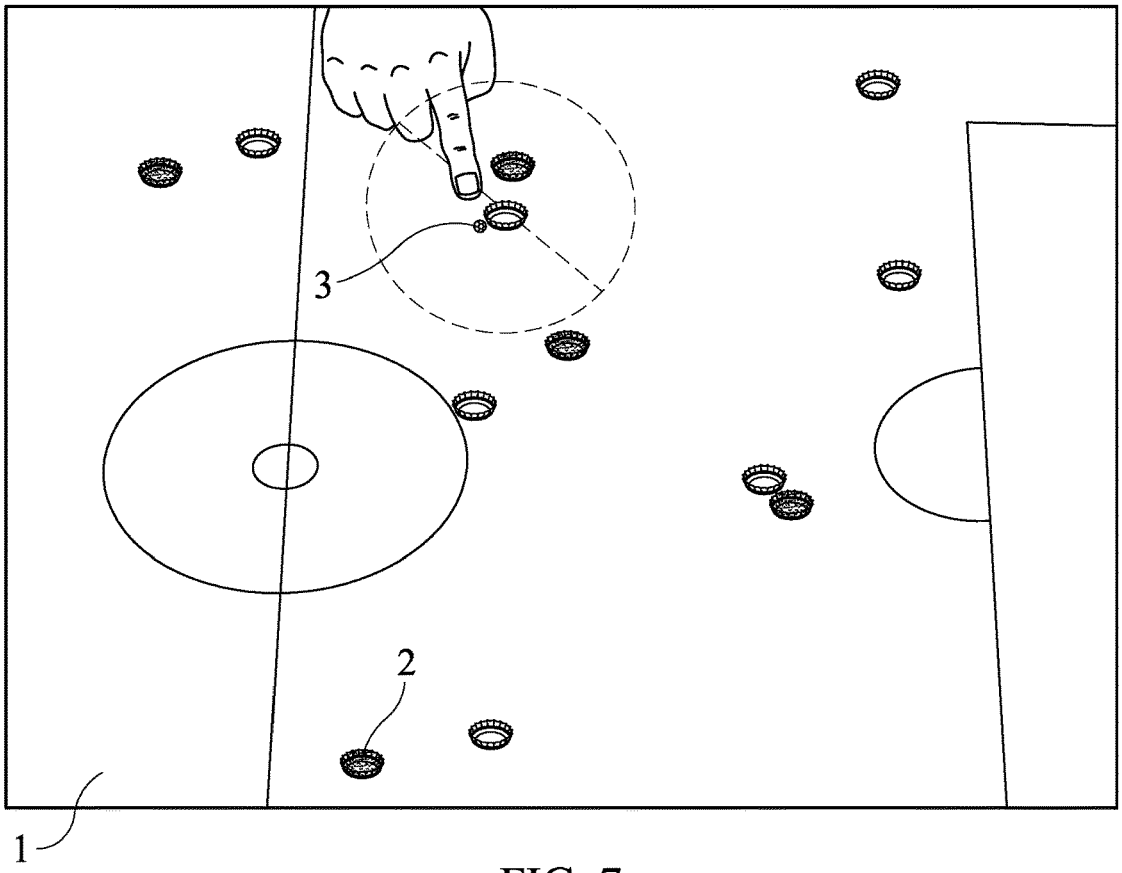
FIG. 7 is a line drawing evidencing the sphere of control.

FIG. 7 shows a bottlecap player 2 with possession of the ball 3 and, in broken lines, shows the invisible "sphere of control" around such player. A player has control of the ball (i.e., possession) if the player is closest to the ball. The controlling player's sphere of control is the area around him within which he is indisputably the closest player to the ball. That area, though, may only extend up to six inches in diameter around him. While proceeding, for example by dribbling, if the player in possession is still the closest to the ball he can be progressing down the field and his sphere of control moves along with him. As shown in FIG. 7, a defender player is less than 3" from the player with possession, but still not closest to the ball.

Figure 8:
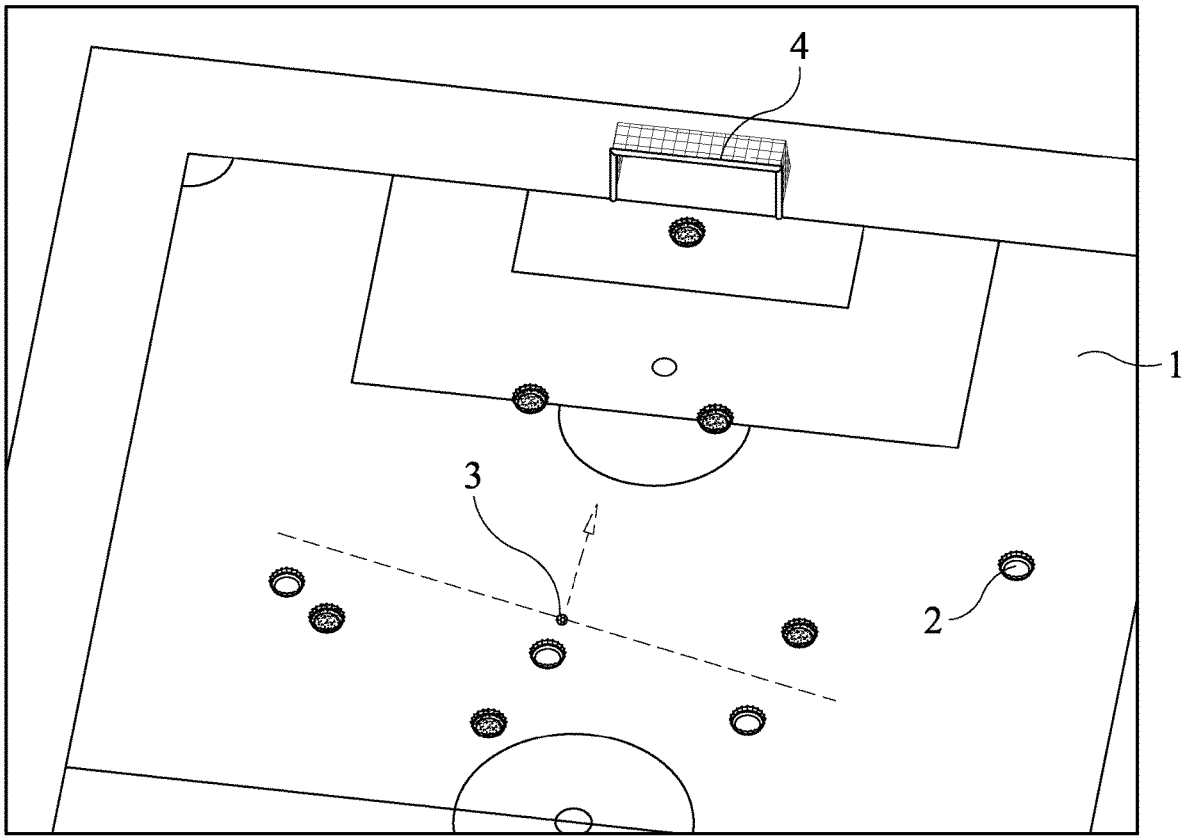
FIG. 8 is a line drawing evidencing direction of play.

FIG. 8 shows multiple bottlecap players 2 on the field 1 to evidence direction of play. The direction the player in possession chooses to progress towards will be considered the direction of play. Defenders attempting to contest the player in possession—by sliding in, to contest possession, or to block a pass, or shot, or header—must be ahead of the direction of play in order to become involved with the play. A dribbler who has gotten past a defender and left him behind the direction of play has thereby eliminated that defender from the play. To become involved with the current play, those defensive players not ahead of the direction of the play must be moved, six inches at a time, until they are ahead of the direction of play. In FIG. 8, the player nearest (in possession of) the ball is dribbling toward his opponent's goal 4, so that is the direction of play. Three defenders are between the dribbler and the goal are in the direction of play and thus any of those three defenders may contest the dribbler when its dribble takes the ball within six inches of them, but those players behind the dribbler are opposite the direction of play and thus out of the play. In the pictured example, if the dribbler turns to his left, he may easily put the nearest defender behind the direction of play and thus out of the play.

Figure 9:
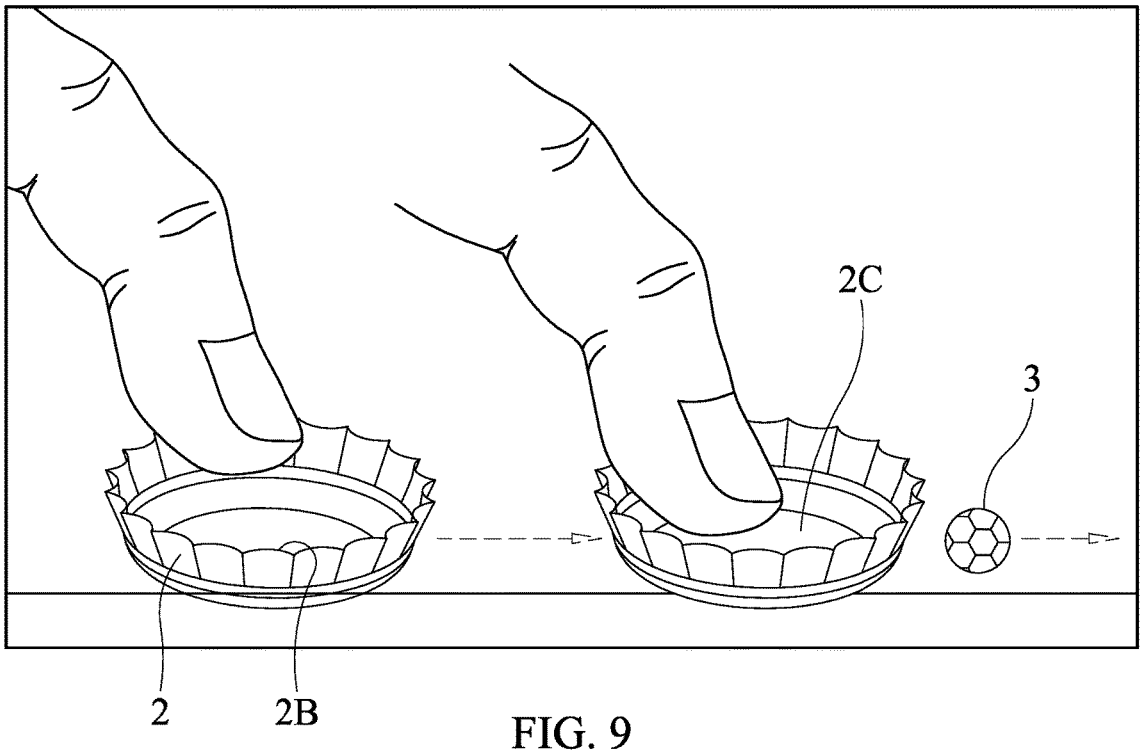
FIG. 9 is a line drawing evidencing dribbling.

FIG. 9 shows a user executing a dribble move by a bottlecap player 2 with his finger. Dribbling is performed by putting a finger inside a player crown 2B and on the inner surface 2D, thus sliding the player until it makes contact with the ball 3, tapping the ball as expressed above, while keeping the ball within the player's sphere of control at all times. A single player may successfully dribble (tap the ball) within his sphere of control up to five times in a row without being contested by an opposing player. If the player in possession has managed to keep control after a contest he may again choose to dribble for up to five taps.

Figure 10A:
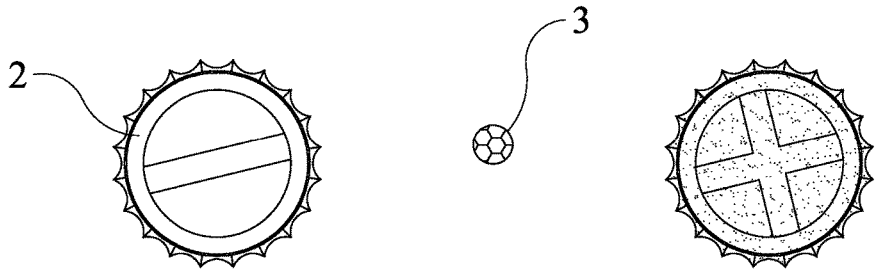
FIG. 10A-10C is each a line drawing evidencing a contest of possession.
Figure 10B:
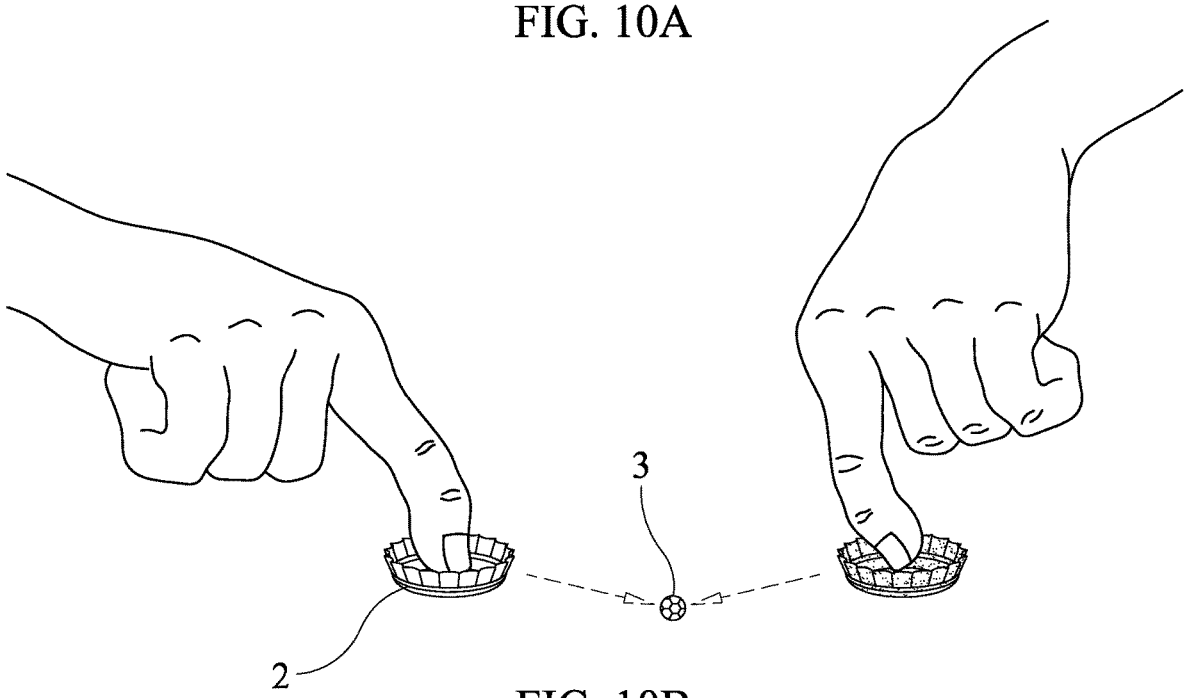
Figure 10C:
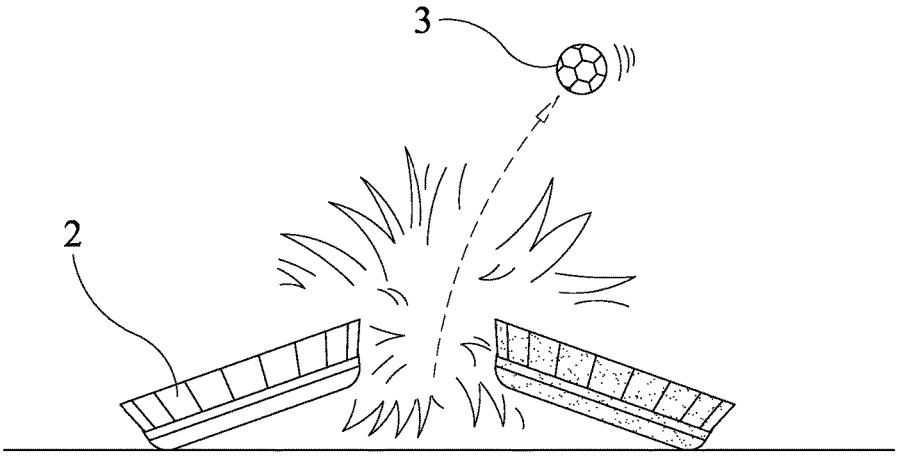

FIGS. 10A-10C show the movements executed by a player contesting possession of the ball. After the player in possession has dribbled his allotted five taps, or whenever the ball enters a free area outside any one player's sphere of control and the opposing user has one or more bottlecap players 2 within six inches of the ball, such user may contest possession by sliding their closest bottlecap toward the ball. The contesting of possession may take place whether or not the ball is in the dribbler's sphere of control. The slide is performed with the same motion as a tap only the bottlecap itself moves or slides toward the ball in contention and the user removes his finger from the sliding player at the end of the motion. Contesting players may crash when vying for the ball.

FIG. 10A evidences a dribbling player 2 on the left and a contesting player 2 on the right, with the ball 3 in between and within six inches of both players. FIG. 10B shows the opposing each initiating a slide by his player closest to the ball. FIG. 10C shows the two players colliding and the ball leaving the field 1 as a result of such collision.

Figure 11:
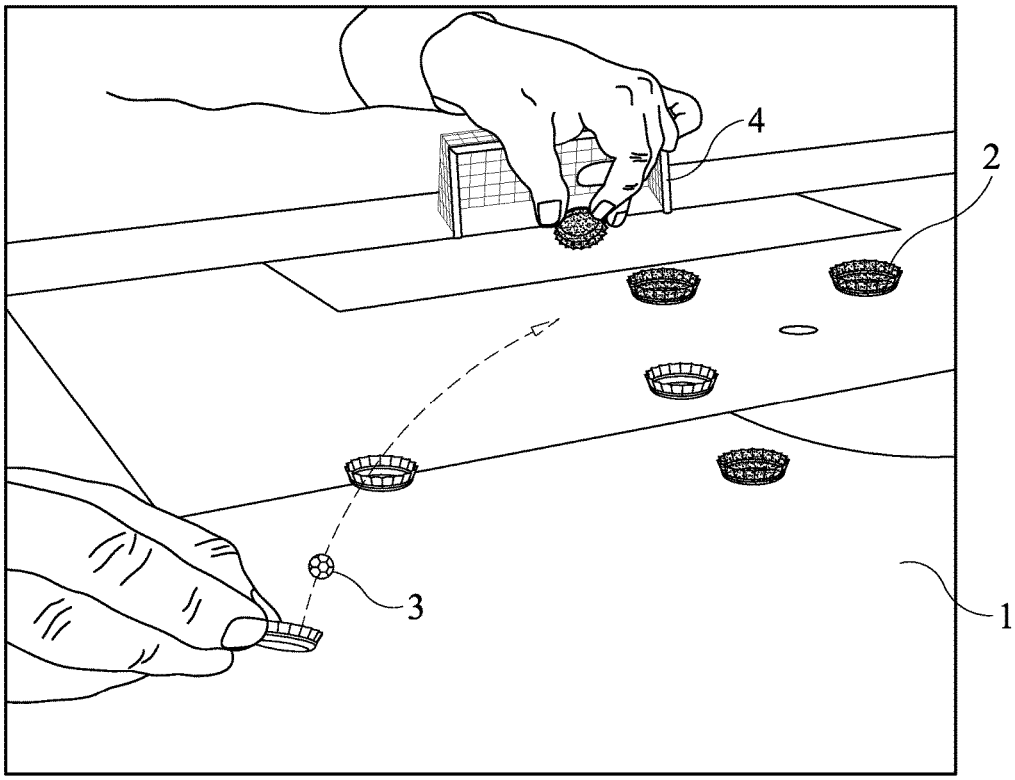
FIG. 11 is a line drawing evidencing a shot on goal.

FIG. 11 shows a user taking a shot on goal 4 with a player 2 by executing a scoop kick sending the ball 4 into the air. A shot on goal, either by tap or scoop motion, may be taken at any time in the run of play, from inside the legal distance, without warning and that shot may result in a goal.

Figure 12:
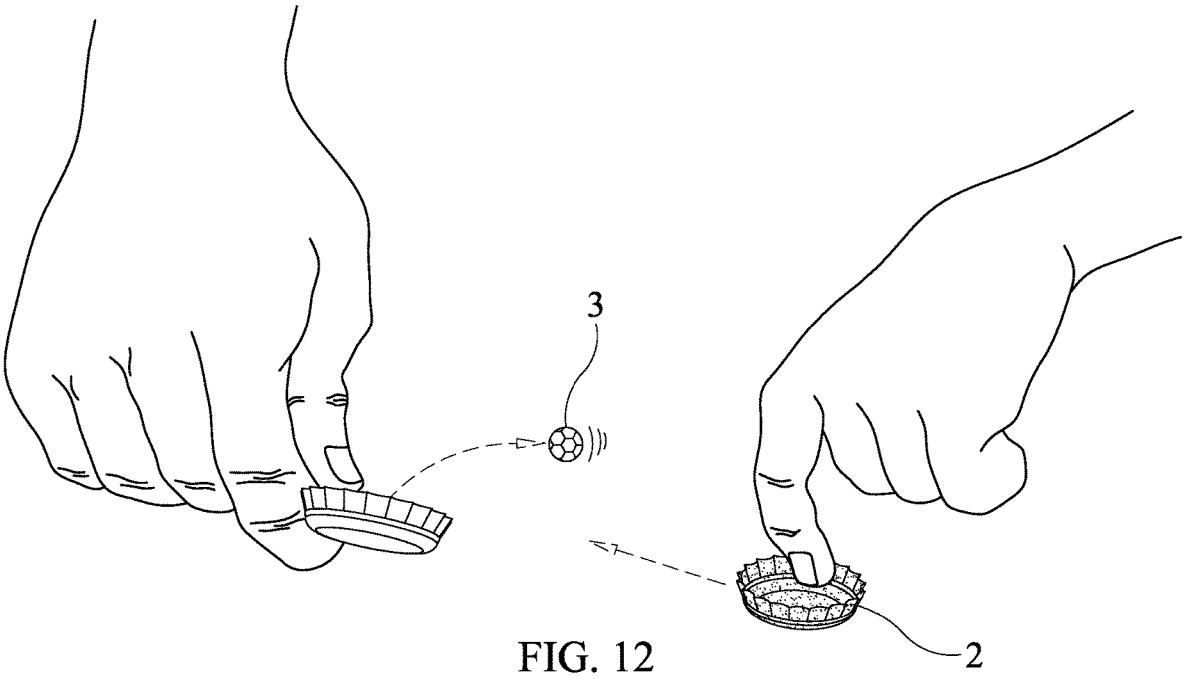
FIG. 12 is a line drawing evidencing a block.

FIG. 12 shows a defensive player 2 on the right executing a sliding block, while the offensive player on the left attempts a scoop shot. A block is performed by the user putting a finger inside a bottlecap player and sliding the bottlecap along the field 1 toward the expected direction of the opponent's action rather than toward the player taking the action. For a related defensive move, the standing block (not pictured), the user places his finger inside the player crown to hold the player upright at a right angle to the field.

Figure 13:
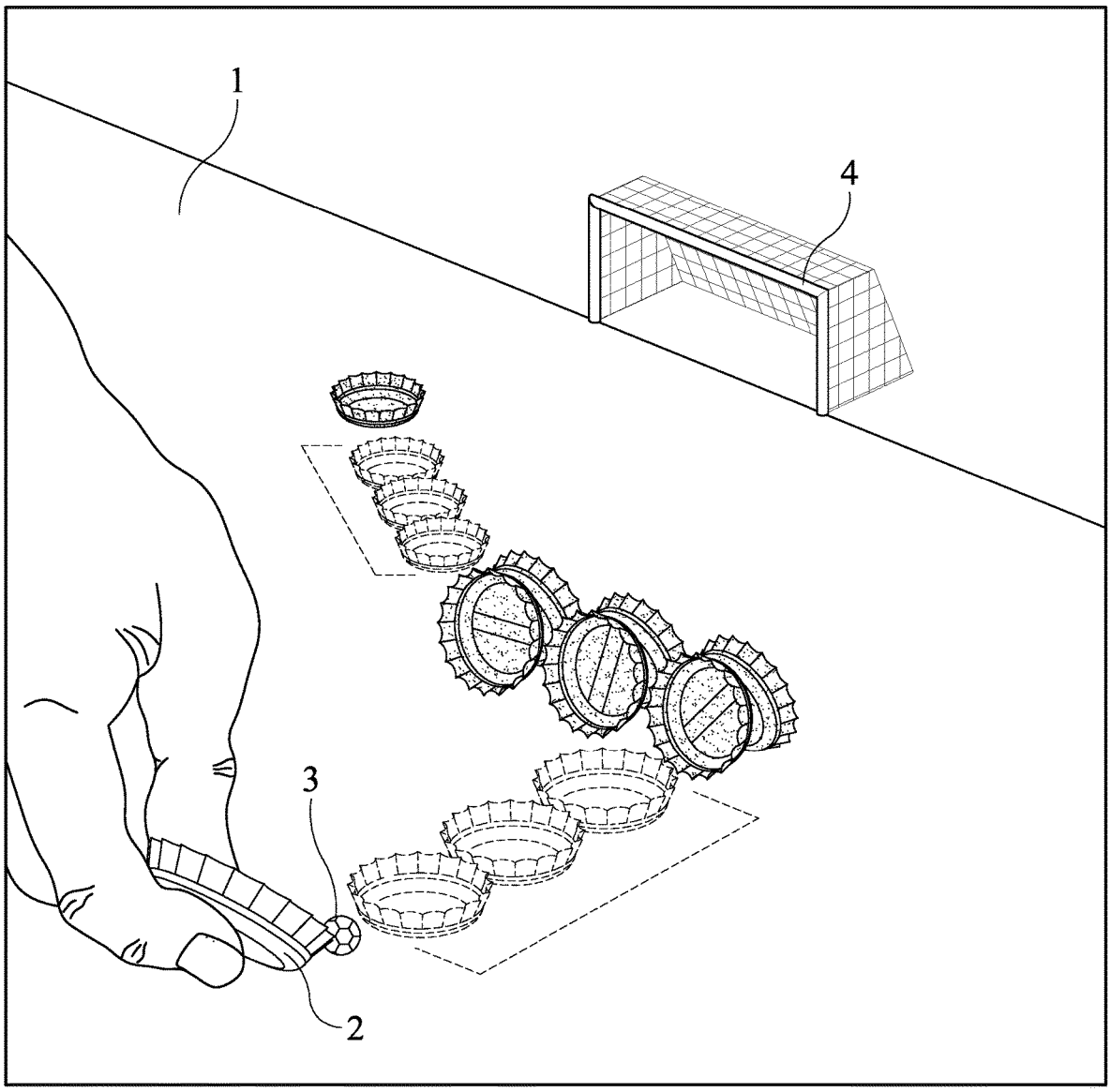
FIG. 13 is a line drawing evidencing the three manners of a foul.

FIG. 13 shows the execution of a free kick while the defense creates a defensive wall. A free kick, taken after a penalty on the other team, can be taken at goal 4 as long as it is within the legal shooting space. If the user taking the free kick intends on shooting the ball 3 directly at the goal 4, he must tell the user on defense first to enable the defender to create a defensive wall. The wall is placed three bottlecap-lengths (shown in broken lines) away from the position of the ball and is built by placing pair(s) of defensive bottlecaps 2, leaning top 2A against top, with each pair thus balancing to stand up the bottlecaps. Defenders may place as many players in the wall as desired and, once the first two are upright, other players as pairs or singly may simply be placed alongside to augment the wall. No defensive players may be placed inside the three bottlecap circumference around the location of the ball until the ball has been played. Once the wall is set the defender states he is ready and then the offensive player has five seconds to play the ball. Once the shot has been taken the defender may dismantle his entire wall by picking up and placing the defenders back down on the playing field within three cap lengths of where the wall stood, indicated in broken lines, thereafter he may only move his players singly and six inches at a time.

Figure 14A:
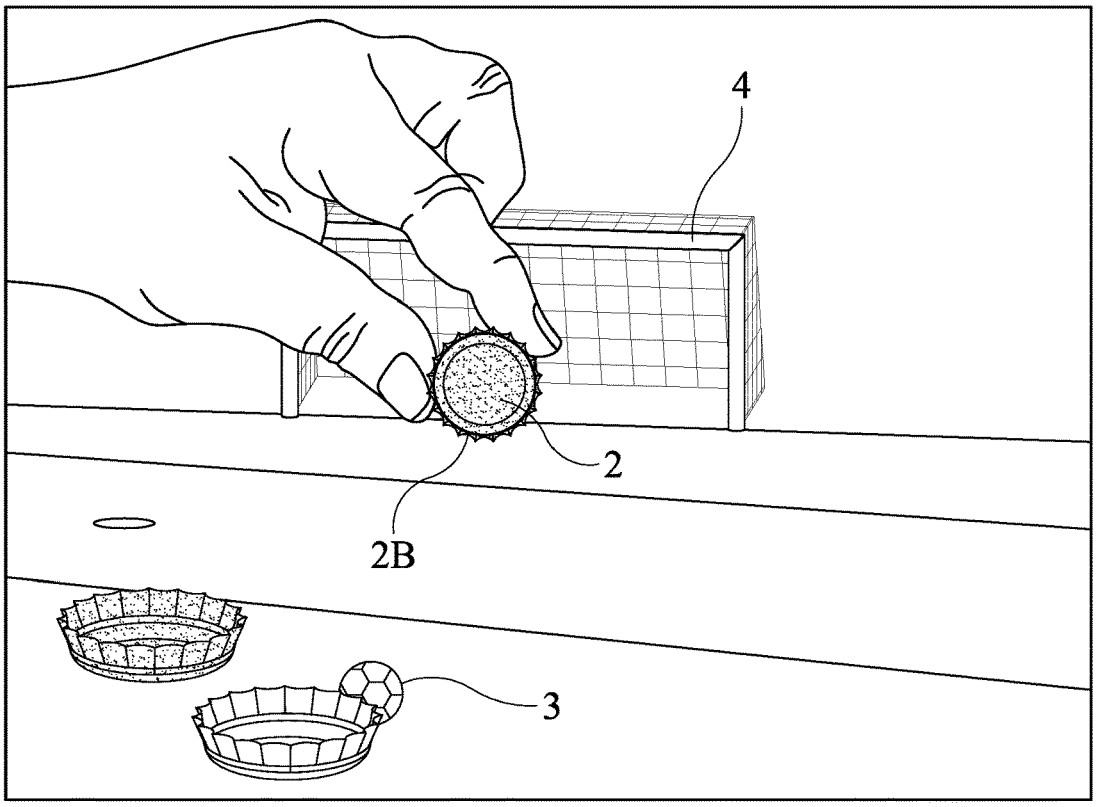
FIG. 14A-14D is each a line drawing evidencing the two manners of a hand ball.
Figure 14B:
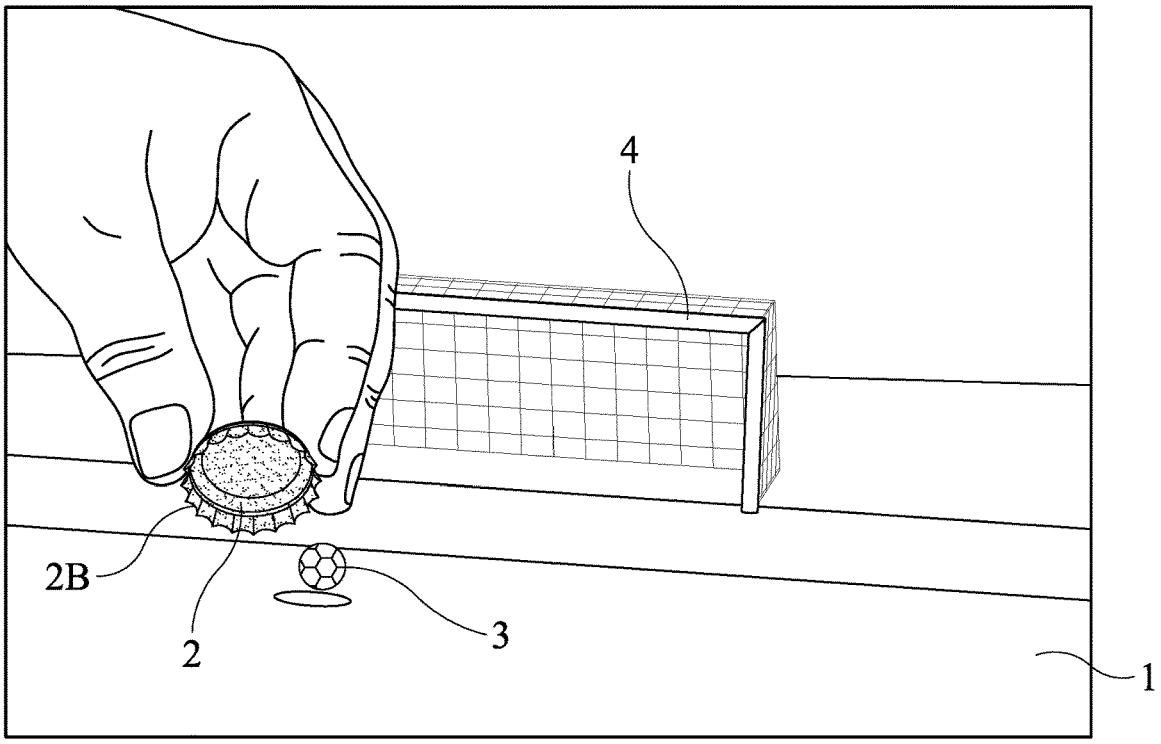
Figure 14C:
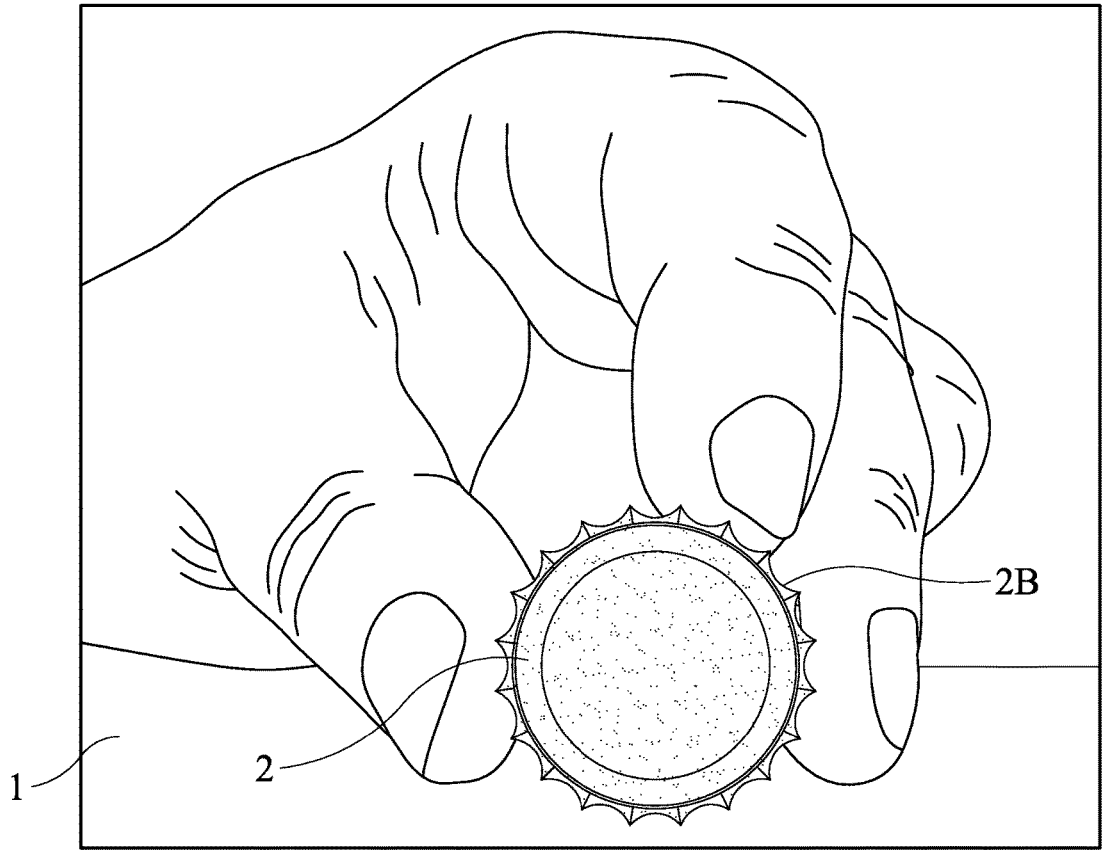
Figure 14D:
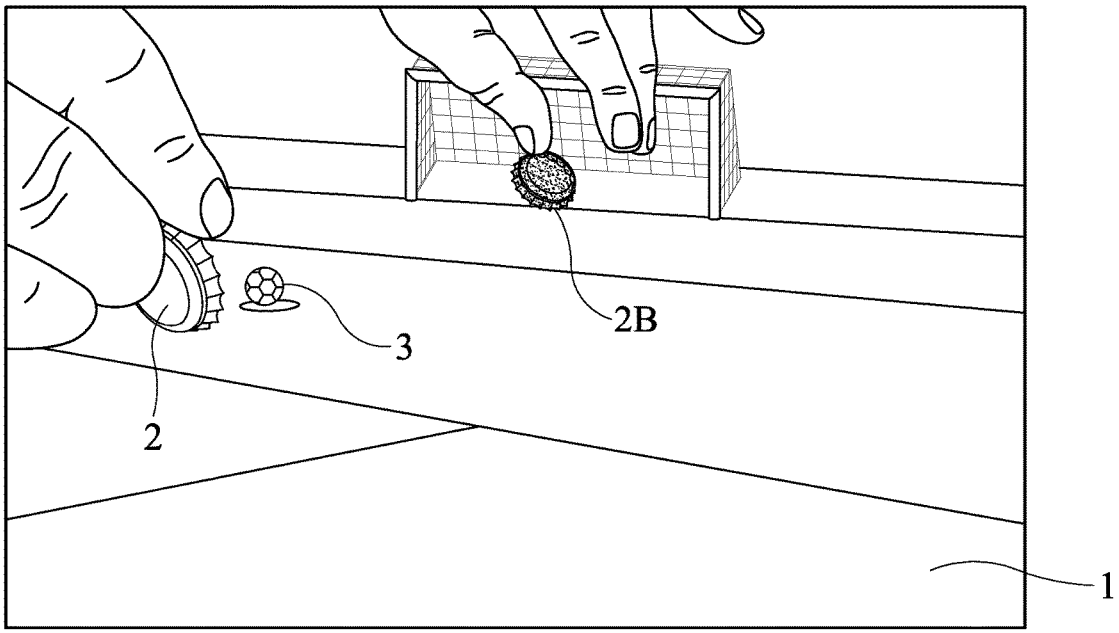

FIGS. 14A-D show the four manners of holding a bottlecap player 2 acting as a goalkeeper while located inside the goal area 7. To play the keeper the user picks up the bottlecap in one of four ways and places it upright while keeping the bottlecap in contact with the pitch 1, the top side 2A facing the goal and the crown side 2B facing the play. In FIG. 14A, the user holds the bottlecap player 2 on both sides of the crown 2B with the index and thumb on either side of the bottlecap. In FIG. 14B, the user holds the bottlecap player 2 with the index and middle fingers on one side and the thumb on the other side. In FIG. 14C, the user's holds the bottlecap player 2 with the thumb and middle finger holding opposite sides of the bottlecap while the index finger lies on the top of the bottlecap with its bottom in contact with the pitch 1. In FIG. 4D, the user places a single finger on the top side of the crown 2B of the bottlecap player 2 to hold the player in place against the pitch 1 or roll the player along the pitch to intercept the ball 4.

Figure 15:
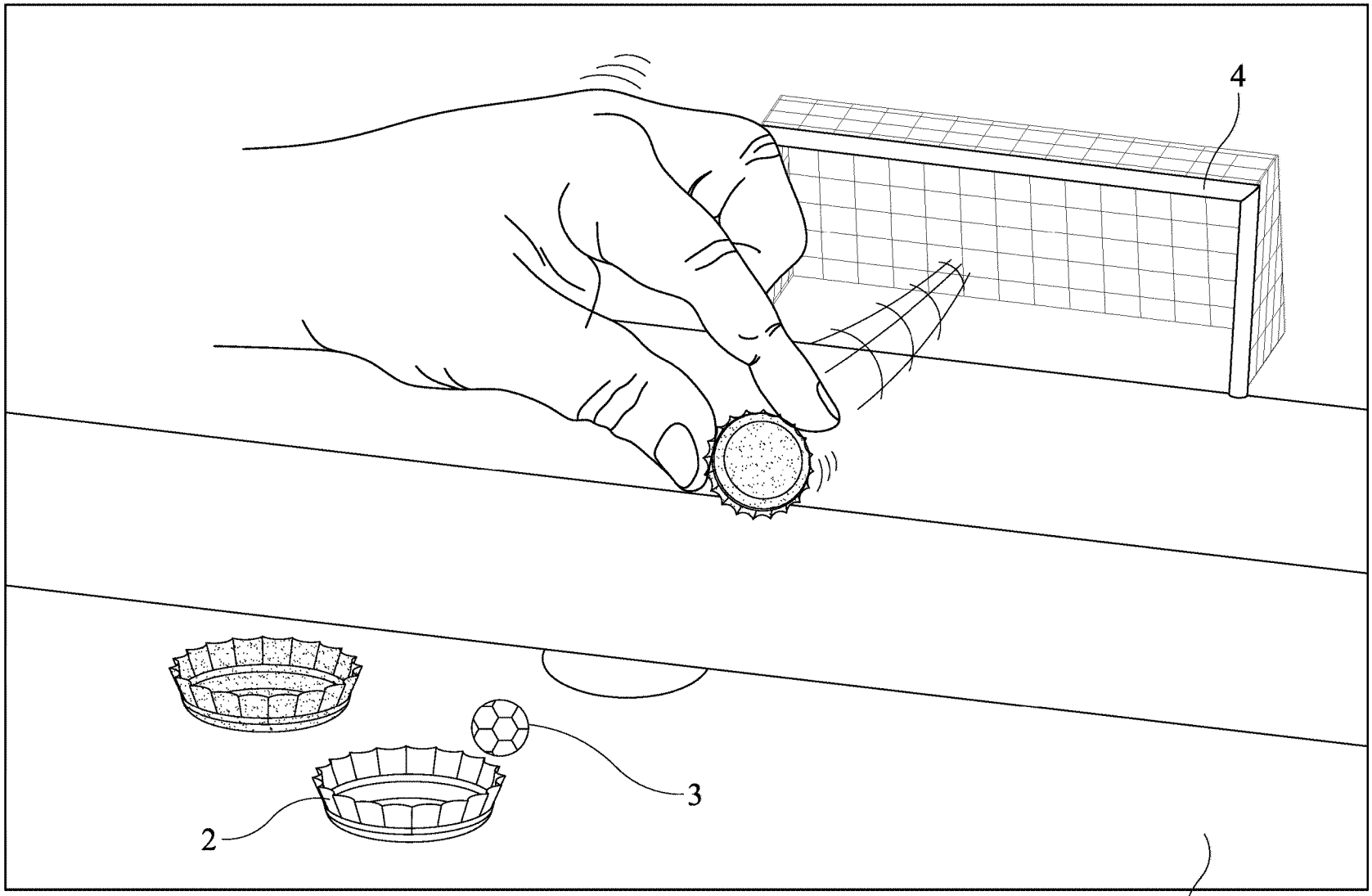
FIG. 15 is a line drawing evidencing a penalty kick.

FIG. 15, again showing a user engaging a bottlecap player 2 employed as a goal keeper inside the goal area 7, the user may use any legal grip to advance the player up to six inches in any direction. Once the advance move is made, the player may remain in place or turn to attempt to block or obstruct a shot or shot angle, then optionally either dive or slide to execute a block.

Figure 16:
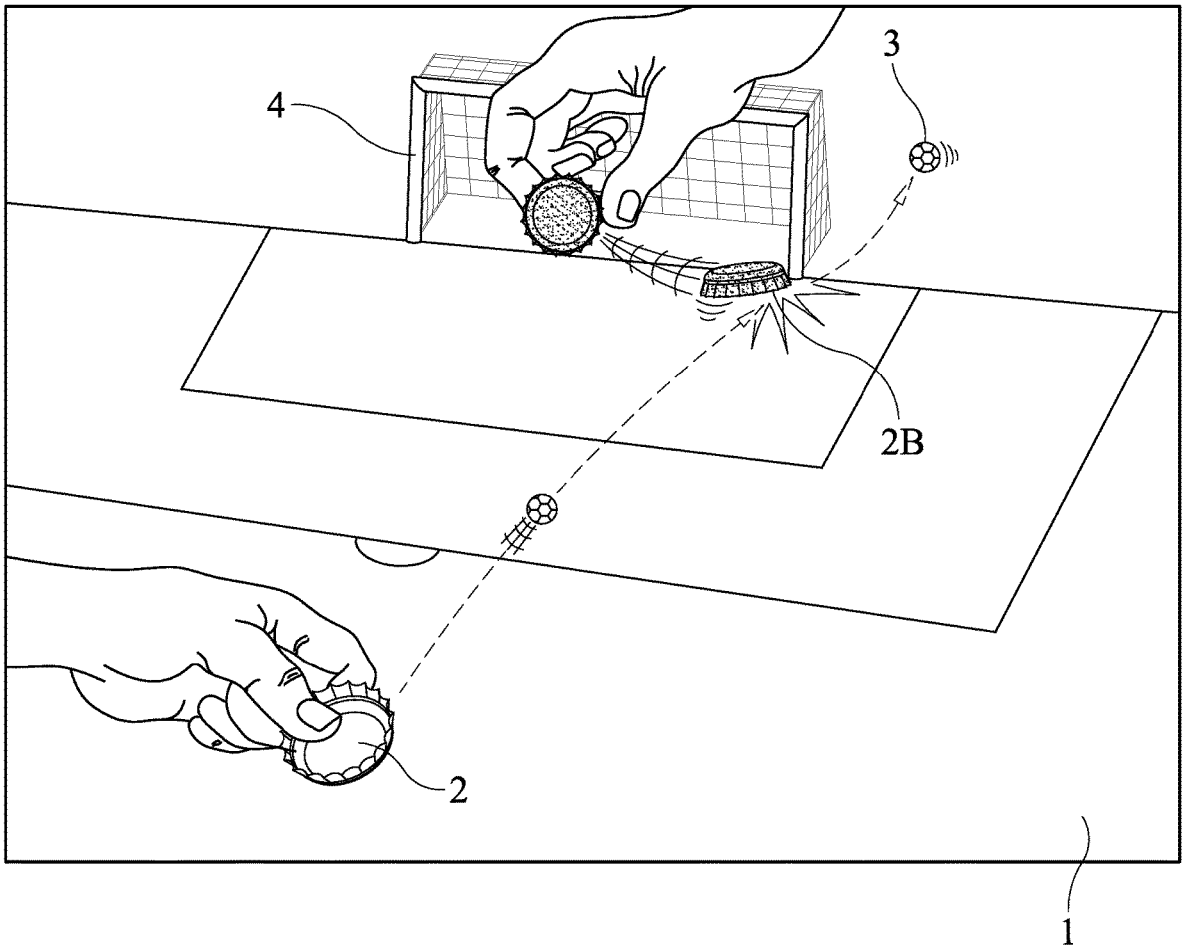
FIG. 16 is a line drawing evidencing a free kick with a wall.

FIG. 16 shows a bottlecap player 2 acting as a goal keeper inside the goal area 7 and executing a slide to block the ball 3 during an incoming shot on the goal 4. A dive, which is the only keeper movement which requires the user maintain his hand in contact with the field 1, the user holds the keeper in any of the first three permitted grip stances and then flings the keeper, with the crown side 2B facing the ball 3, for a distance of up to six inches, in an attempt to block the shot.

LIST OF REFERENCE NUMBERS

1 pitch/field
2 bottlecap player
2A top
2B crown
2C inner surface
3 ball
4 goal
5 midfield line
6 center circle
7 goal area
8 penalty area
9 penalty mark
10 penalty arc
11 goal line
12 sideline (touchline)
13 corner arc The references recited herein are incorporated herein in their entirety, particularly as they relate to teaching the level of ordinary skill in this art and for any disclosure necessary for the more common understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

I claim:

1. A method of play of a tabletop soccer game, played by a first person and a second person, such game comprising:

a soccer pitch made of cloth or a similar material marked with lines denoting sidelines, end lines, a midfield line, center circle, penalty areas and goal areas, penalty marks and arcs, corner arcs and defensive player allowable-distance marks, and goal placement marks;

22 bottlecaps, each marked with a different number, each constituting a player, comprising two teams of 11 players, with each team painted a different color;

two goals; and a ball;

the method comprising the steps of:

1. the first person kicking off from the midfield line by passing the ball from one player to another, wherein each such move constitutes either a scoop or a tap;
2. the first person continuing to make moves, each such move from the taken group consisting of: repositioning a player, dribbling, passing, shooting, heading, or throwing-in, until possession of the ball changes;
3. the second person making simultaneous moves to counter the first person's moves, such moves taken from the group consisting of: repositioning a player, sliding a player to contest possession, attempting to block or blocking a pass or shot, heading, or diving, until possession of the ball changes;
4. determining possession after each move by measuring a sphere of control constituting either a circle with a six-inch diameter around the player with the ball, wherein (i) a player controls the ball when the ball is solely within the player's sphere of control and (ii) the player closest to the ball controls the ball when the ball is within more than one players' sphere of control;
5. if one player is dribbling and maintaining control, repeating up to five tap moves within such player's sphere of control before the other player may contest possession;
6. the second person contesting possession by sliding a player at the ball from up to 6 inches after the first player dribbles five times, or the dribbling player moves the ball outside his sphere of control;
7. awarding possession to the second person in the event the ball comes to rest solely in the second person's player's sphere of control, or if the second person's player is nearest to the ball;
8. Each person continuing to make simultaneous moves and counter moves until a goal is scored, a foul has been committed, or the half or full game have ended;
9. Awarding one point to a team each time a person's player scores a goal by having the ball go into the other person's goal; and
10. Naming a winner of the game to the person with the highest score, or calling a draw if no person has a highest score, once the game time has expired.

2. The method of claim 1, wherein shooting, dribbling or passing the ball may be accomplished with a scoop, wherein a person places his fingers on either side of the player, keeps such person's hand in contact with the field, and swipes the fingers upward to scoop the ball with the player in a desired direction, or a tap, wherein the person places his finger on the top of the player, keeps such person's hand in contact with the field, and pushes the player to strike the ball in a desired direction.

3. The method of claim 1, wherein, when the ball lands in the crown of a player due to the run of play, shooting, dribbling or passing the ball may be accomplished with a header, wherein the person holds the player between a thumb and finger, keeps such person's hand in contact with the field, and flips the ball forward with a snapping motion of the thumb and finger.

4. The method of claim 1, wherein, when the ball goes out of bounds, reentry is accomplished by a person taking possession with a throw in, wherein the person holds the bottlecap between a thumb and finger, keeps his hand in contact with out of bounds area, and flips the ball forward with a snapping motion of the thumb and finger.

5. The method of claim 1, wherein additional available player moves are taken from the group comprising a volley shot, a block, a bicycle kick, a backheel shot or pass, and a diving header.

6. The method of claim 1, wherein a person may be awarded a free kick upon an opponent committing a foul, and the opponent may form a defensive wall with his players prior to the free kick.

7. The method of claim 1, wherein one of each person's players is a goalkeeper, and each goalkeeper may be held in an upright position without the person's hand maintaining contact with the field unless the goalkeeper is performing a dive.

* * * * *